US005709003A

United States Patent [19]

Batch

[11] Patent Number: 5,709,003

[45] Date of Patent: Jan. 20, 1998

[54] CRANK ARM CLEANING BRUSH WITH SCRUB PAD

[76] Inventor: Charles W. Batch, P.O. Box 19004, Pensacola, Fla. 32523

[21] Appl. No.: 646,912

[22] Filed: May 8, 1996

[51] Int. Cl.[6] ..... A46B 3/18; A46B 15/00

[52] U.S. Cl. ..... 15/106; 15/65; 15/164

[58] Field of Search ..... 15/164, 106, 160, 15/165, 184, 210.1, 206, 159.1, 211, 104.05, 65

[56] References Cited

U.S. PATENT DOCUMENTS

| | | | |
|---|---|---|---|
| 1,014,236 | 1/1912 | Lawhon | 15/165 |
| 2,055,813 | 9/1936 | Cassius | 15/165 |
| 2,339,123 | 1/1944 | Volckening | 15/164 |
| 2,584,503 | 2/1952 | Schleenbaker | 15/106 |
| 3,451,723 | 6/1969 | Marks | 300/21 |
| 3,862,461 | 1/1975 | Buckitzsch | 15/164 |
| 4,360,940 | 11/1982 | Smith | 15/160 |
| 5,435,036 | 7/1995 | Hedrick et al. | 15/59 |
| 5,491,863 | 2/1996 | Dunn | 15/164 |
| 5,513,410 | 5/1996 | Liu | 15/164 |

FOREIGN PATENT DOCUMENTS

| | | | |
|---|---|---|---|
| 37940 | 1/1886 | Germany | 15/164 |
| 470273 | 1/1929 | Germany | 15/165 |
| 832137 | 2/1952 | Germany | 15/164 |
| 22161 | 10/1902 | United Kingdom | 15/164 |
| 25423 | 11/1902 | United Kingdom | 15/164 |
| 27732 | 11/1909 | United Kingdom | 15/164 |

*Primary Examiner*—Gary K. Graham
*Attorney, Agent, or Firm*—Peter Loffler

[57] ABSTRACT

A cleaning brush is comprised of a shaft having a crank arm and a handle thereon. A rod is removably or fixedly secured to the bottom of the shaft. A plurality of outwardly projecting bristles are disposed along the length of the rod. A scrub brush is removably secured to the bottom of the rod. A nipple brush is disposed within a cavity of the handle for scrub cleaning the nipple of a baby bottle.

8 Claims, 2 Drawing Sheets

30
28
20
22
26
24
16
10
14
12
32
36
34
40
42
44

20
30
28
16
14
12
32
10
36
34
42
44

20
30
28
22
24
26
18
16
10
12
32
36
38
34
40
42
44

12
10
32
34
40
B
42
44

CRANK ARM CLEANING BRUSH WITH SCRUB PAD

BACKGROUND OF THE INVENTION

1. Field of the Invention

The present invention relates to a cleaning brush.

2. Background of the Prior Art

The important of cleaning bottles and containers, such as baby bottles or laboratory containers is well understood. A dirty baby bottle can result in series health consequences for the baby drinking therefrom while an improperly cleaned lab container can corrupt test results causing adverse consequences for those relying on the test results.

Therefore, a strong desire for thoroughly cleaning bottles or containers exists. In order to clean such bottles and containers, one of two methods is typically employed. A cleaning machine utilizing hot water and detergent, such as a dishwasher, is used to automatically clean the target receptacle. However, dishwashers tend to be ill-suited for the cleaning process. Baby bottles and many lab beakers have narrow openings relative to the main body of the bottle. Consequently, the jet spray of the dishwasher has difficulty penetrating into the interior of bottle or container resulting in incomplete cleaning of the object, particularly in the corners, both upper and lower. This incompleteness is even more pronounced when the container has caked on material, such as dried milk.

Alternately, the bottles and containers can be manually cleaned. Hot water and soap or other cleaning agents, coupled with a brush and some elbow grease are utilized in order to clean the object. Although this method cleans the sides of the bottle reasonably well, cleaning of the corners continues to be a problem. In order to clean the corners of a bottle, various brush designs have been proposed. Exemplary of such devices is U.S. Pat. No. 3,862,441 issued to Buckiltzsch that has an outwardly tapered bottom in order to enhance the reach of the brush into the lower corners of the bottle. Due to the tapered nature of the bottom of the device, the bottom of the brush engages the bottom of the bottle with maximum pressure. However, the remainder of the brush imparts contact on side of the bottle with decreased pressure resulting in decreased cleaning of those surfaces. Another cleaning brush is disclosed in U.S. Pat. No. 3,451,723 issued to Marks that has tipped ends. While these tipped ends facilitate bottom cleaning of a bottle, they lack the proper functionality to effectively clean either the upper or the lower corners of the bottle.

Therefore, there is a need in the art for a brush that can be used to manually clean bottles and containers. Such a brush must be capable of reaching all areas of the interior of the receptacle including the upper and lower corners. Ideally, such a device will be of relatively simple and straightforward construction.

SUMMARY OF THE INVENTION

The cleaning brush of the present invention meets the aforementioned needs in the art. The present invention provides a cleaning brush capable of effectively and efficiently cleaning the entire inside surface of a bottle or container including the sides, the bottom, the upper portion, and the lower corner.

The cleaning brush is comprised of a shaft having a crank arm and a handle thereon. A rod is either removably or fixedly secured to the bottom of the shaft. A plurality of outwardly projecting bristles are disposed along the length of the rod. A scrub brush is removably secured to the bottom of the rod. The bristles scrub clean the sides and the upper portion of the bottle while the scrub brush conforms to and scrub cleans the bottom and the bottom corner of the bottle. Additionally, as the scrub brush can be slightly wider than the target container and be resilient, the scrub brush flairs upwardly during insertion providing an initial scrubbing of the sides of the container during insertion.

A nipple brush is disposed within a cavity of the handle for scrub cleaning the nipple of a baby bottle.

The device is quick and easy to use and cleans the entire inner surface of a bottle or other container including any caked on areas. By being removable from the rod, the scrub brush can be easily replaced when worn out.

BRIEF DESCRIPTION OF THE DRAWING

Similar reference numerals refer to similar parts throughout the several views of the drawings.

DETAILED DESCRIPTION OF THE PREFERRED EMBODIMENT

Figure 1:
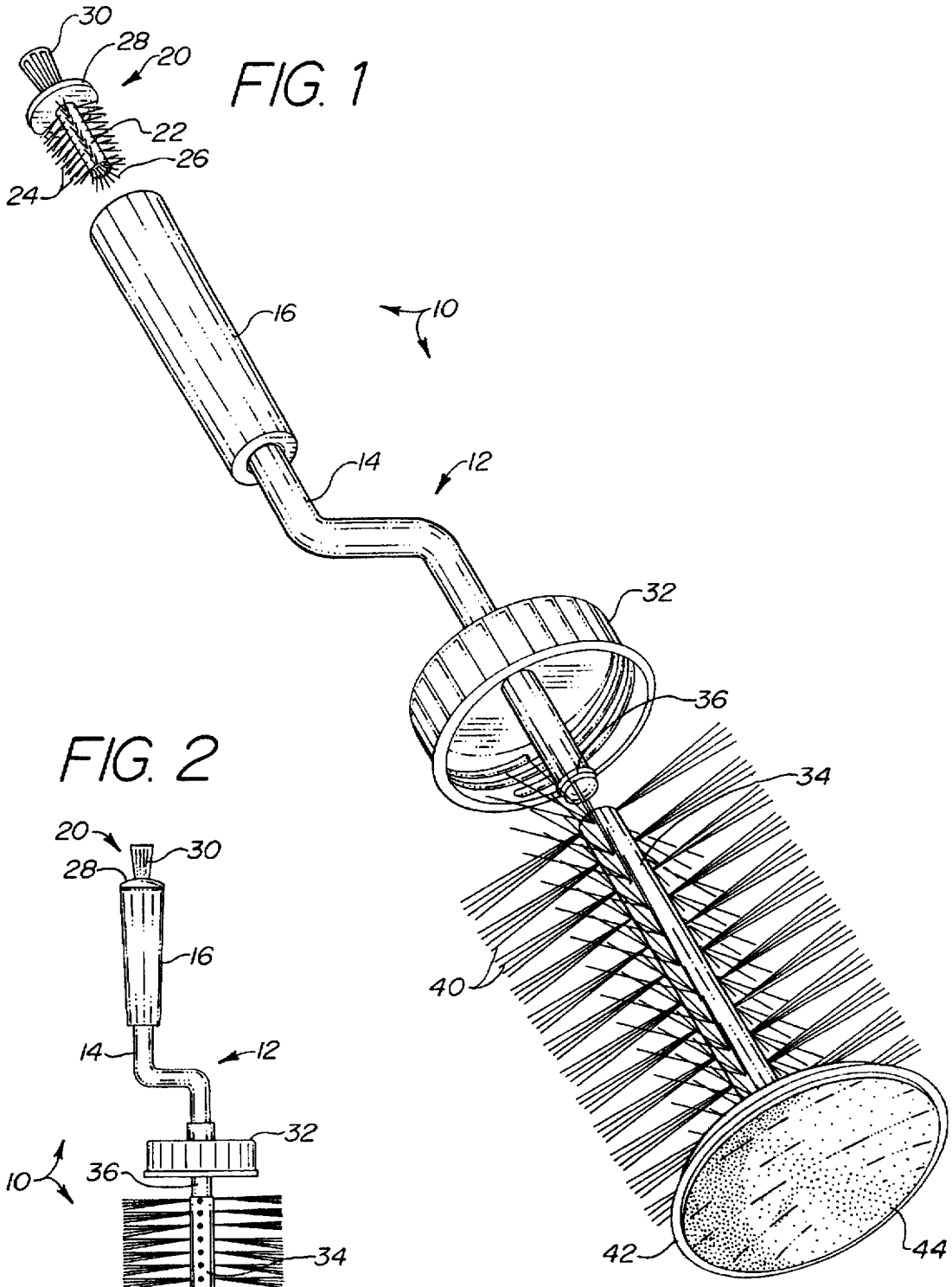
FIG. 1 is an isometric view, partially exploded, of the cleaning brush of the present invention.
Figure 2:
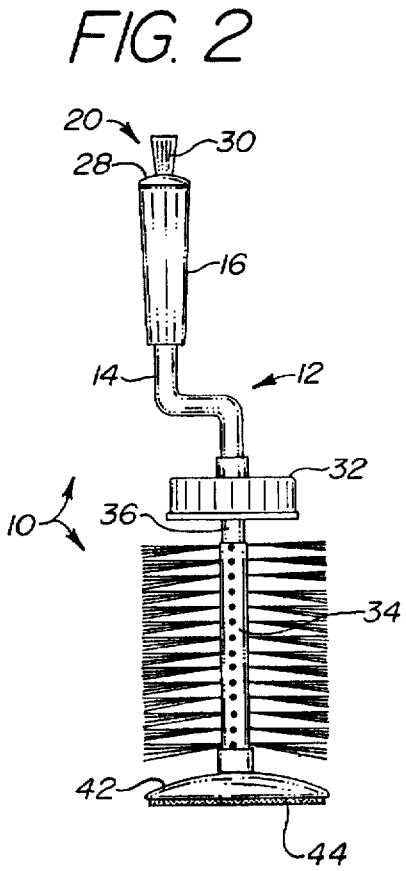
FIG. 2 is a side elevation view of the cleaning brush.
Figure 3:
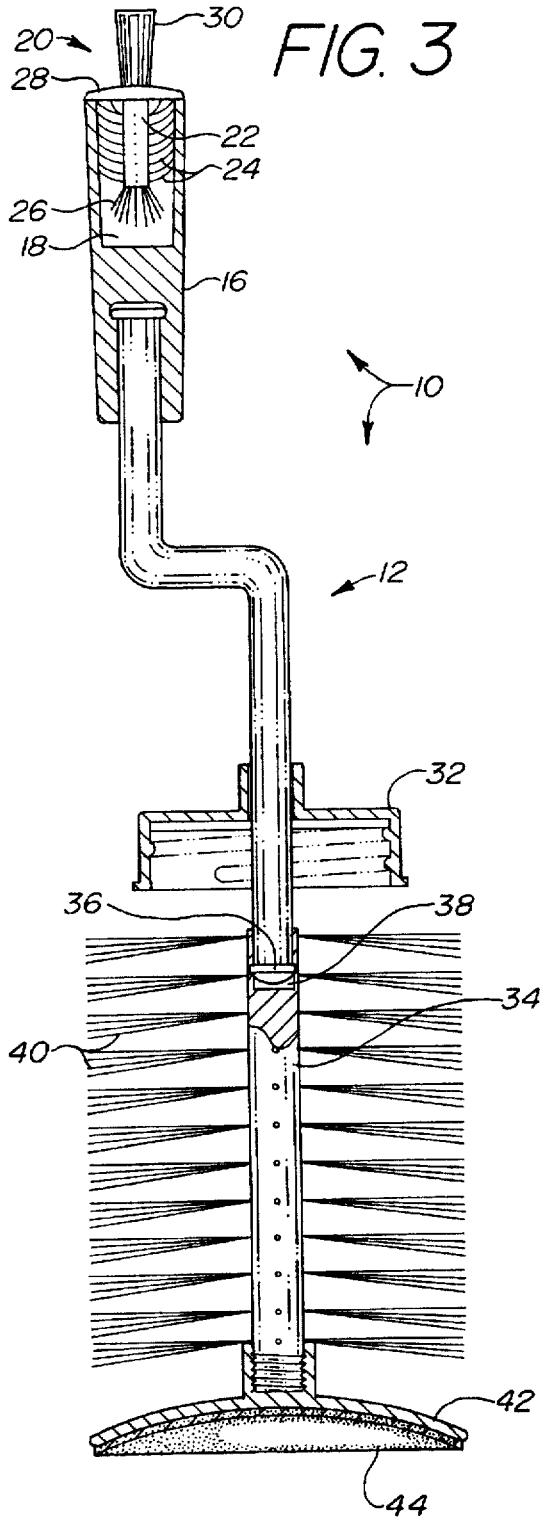
FIG. 3 is a cutaway view of the cleaning brush.
Figure 4:
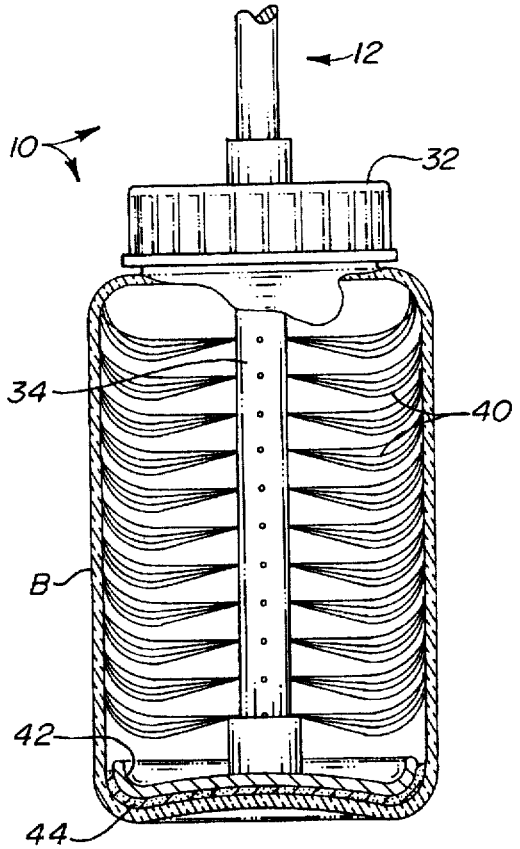
FIG. 4 illustrates the cleaning brush of the present invention inserted into a baby bottle.

Referring now to the drawings, it is seen that the cleaning brush of the present invention, generally denoted by reference numeral 10, is comprised of a shaft 12 having its top portion in the shape of a crank arm 14 with a handle 16 rotatably disposed thereon. As seen in FIG. 3, the top of the handle 16 has a cavity 18 therein. Removably secured within the cavity 18 is a nipple brush 20. The nipple brush 20 is comprised of a stem 22 having a plurality of bristles 24 projecting radially outwardly, disposed along the length of the stem 22 and a plurality of bristles 26 projecting downwardly, disposed on the bottom of the stem 22. A stopper 28, for removably securing the nipple brush 20 within the cavity 18, is attached to the top of the stem 22 while a handle 30 extends upwardly from the stopper 28.

A cap 32 that is either rotatably or snap secured to a bottle B is secured to the bottom portion of the shaft 12. Removably attached to the bottom of the shaft 12 is a rod 34. The bottom of the shaft 12 has a ball end 36 which is friction "snap fit"into place within a cavity 38 of the rod 34. Alternately, the shaft 12 and the rod 34 can be integral. A plurality of bristles 40, projecting radially outwardly, is disposed along the length of the rod 34.

Although the outwardly projecting bristles 40 of the rod 34 are illustrated as being clumped into bunches with each bunch secured within an opening located on the rod 34, it is expressly understood that the bristles 40 may be secured to the rod 34 in any appropriate manner and configuration.

Attached, either threadably, snap fit, or otherwise, to the bottom of the rod 34 is a scrub cap 42 having a concave shape. The scrub cap 42 is made of a resilient material. A scrub brush 44 is secured to the bottom of the scrub cap 42. The scrub brush 44 can be of any appropriate scrubbing material such as a scouring pad-like material, a sponge, a short-bristled pad, or any other appropriate material. The scrub brush 44 can be dimensioned to be flush fit with its target container or to be slightly oversized so that upon insertion into the container, the scrub brush 44 flairs upwardly and provides an initial scrubbing of the sides of the target container.

In order to utilize the cleaning brush 10 of the present invention, the device 10 is assembled by attaching the scrub cap 42 to the bottom of the rod 34 and attaching the shaft 12 to the top of the rod 34, if the two items are not integral. A bottle B or other container may be partially filled with desired cleaning solution and the brush 10 inserted into the bottle B until the bristles 40 are completely received within the bottle B. Once so positioned, the bristles 40 engage the sides and upper portion of the bottle B, while the scrub brush 44 engages the bottom of the bottle B. By being resilient, the scrub cap 42 and the scrub brush 44 conform to the shape of the bottom of the bottle B. The scrub brush will engage the corners of the bottle B.

The cap 32 is threadably or "snap fit"secured to the top of the bottle B. The user grasps the handle 16 and rotates the handle 16 thereby effecting rotation of the rod 34 causing the bristles 40 to scrub clean the sides and upper portion of the bottle B. The rotating rod 34 also causes rotation of the scrub cap 42 and scrub brush 44 causing the scrub brush 44 to scrub clean the bottom and bottom corner of the bottle B. Once the cleaning process is completed, the device 10 is withdrawn from the bottle B.

As the handle 16 is rotatably secured to the shaft 12, the user does not have to let the handle 16, free spin within his hand, but can firmly grip the handle 16.

If desired, the nipple brush 20 is withdrawn and used to scrub clean the nipple (not illustrated) of the bottle B if the target bottle is a baby bottle.

While the invention has been particularly shown and described with reference to an embodiment thereof, it will be appreciated by those skilled in the art that various changes in form and detail may be made without departing from the spirit and scope of the invention.

I claim:

1. A cleaning brush for removable attachment to a vessel to be cleaned comprising:

a shaft having a topend, a bottomend, a crank arm therebetween;

a handle attached to the top end of the shaft;

a rod secured to the bottom end of the shaft;

a plurality of bristles projecting outwardly from the rod;

a securing cap, impaled by the shaft, adapted to removably secure the clearing brush to the vessel; and a generally concave and resilient scrub cap defining a concave surface, said surface having a scouring pad secured thereto to define a concave scrub surface, the scrub cap to an end of the rod.

2. The device as in claim 1 to further include a nipple brush removably secured within the handle.

3. The cleaning brush as in claim 1 wherein the rod is removably secured to the shaft.

4. The cleaning brush as in claim 1 wherein the scrub cap is removably secured to the rod.

5. A cleaning brush for removable attachment to a vessel to be cleaned comprising:

a shaft having a top end, a bottom end, and a crank arm therebetween;

a handle attached to the top end of the shaft;

a rod secured to the bottom end of the shaft;

a plurality of bristles projecting outwardly from the rod;

a securing cap, impaled by the shaft, adapted to removably secure the cleaning brush to the vessel; and a generally concave and resilient scrub cap defining a concave surface, said surface having a sponge pad secured thereto to define a concave scrub surface, the scrub cap secured to an end of the rod.

6. The cleaning brush as in claim 5 further comprising a nipple brush removably secured within the handle.

7. The cleaning brush as in claim wherein the rod is removably secured to the shaft.

8. The cleaning brush as in claim 5 wherein the scrub cap is removably secured to the rod.

* * * * *